United States Patent [19]

Schulze-Berge

[11] 4,001,470

[45] Jan. 4, 1977

[54] PROCESS AND BATH FOR THE METALLIZATION OF SYNTHETIC-RESIN

[75] Inventor: Klaus Schulze-Berge, Remscheid-Luttringhausen, Germany

[73] Assignee: Langbein-Pfanhauser Werke AG, Neuss, Germany

[22] Filed: Apr. 16, 1975

[21] Appl. No.: 568,733

[30] Foreign Application Priority Data

Apr. 18, 1974 Germany ..... 2418654

[52] U.S. Cl. ..... 427/304; 427/306; 106/1

[51] Int. Cl.[2] ..... C23C 3/02

[58] Field of Search ..... 427/304, 305, 306, 92, 427/98; 106/1

[56] References Cited

UNITED STATES PATENTS 3,011,920 12/1961 Shipley ..... 252/472 X

FOREIGN PATENTS OR APPLICATIONS 806,977 1/1959 United Kingdom ..... 427/98

*Primary Examiner*—Ralph S. Kendall
*Attorney, Agent, or Firm*—Karl F. Ross; Herbert Dubno

[57] ABSTRACT

A process for the chemical coating of synthetic-resin bodies with nickel or copper utilizing an activation step in which the bath comprises:

0.1 to 20 g gelatin or gum arabic as the protective colloid, 1 to 5 g tartaric acid or citric acid, 1 to 5 g sulfuric acid or hydrochloric acid, 0.1 to 5 g palladium sulfate, 1 to 20 g maleic acid or 1 to 6 g fumaric acid as poly basic carboxylic acids, and water to a volume of 1 liter. The subsequent treatment with the chemical plating bath is carried out without an intervening acceleration treatment.

9 Claims, No Drawings

PROCESS AND BATH FOR THE METALLIZATION OF SYNTHETIC-RESIN

FIELD OF THE INVENTION

The present invention relates to a method of coating synthetic-resin bodies with metals, (metallization) in a currentless system (i.e. electroless plating) and to a bath therefor.

BACKGROUND OF THE INVENTION

It is known to coat the surfaces of synthetic-resin bodies, for example acrylonitrile-butadiene-styrene (ABS) terpolymers with metals by a process which has been termed currentless, electroless or chemical plating. Typical among the processes provided for this purpose is that described in German Pat. No. 1,197,720 in which a palladium salt in finely divided colloidal form, together with a tin hydrosol, is brought into contact with the synthetic-resin body surface. This treatment applies a metal-precipitating catalyzing metal salt to the surface of the body, which surface may be chemically roughened, so that the body can then be brought into contact with a metal-coating bath to deposit the metal upon the body.

In the system described in this patent, however, the colloidal system requires a high hydrochloric acid concentration and the pH must be maintained well below 1 to prevent the colloidal palladium metal from precipitating from the liquid phase.

To remove the high acidity of the surface, the body must be thoroughly rinsed before chemical plating with the metal to be deposited. The rinsing water is thereby highly contaminated and constitutes an environmental pollution hazard. When the rinsing step is omitted, however, problems are encountered with the subsequent chemical plating. For example, ammonium chloride mist is produced when the chemical plating step makes use of conventional ammoniacal nickel baths. The colloid is also oxidation sensitive and tends to become unstable since the solution no longer contains their divalent tin ions.

The conventional process thus requires the removal of the greater part of the catalytically effective palladium metal from the synthetic-resin body surface together with the hydrolyzed tin sol in a special operating step and in the absence of this step results in a poor product. The step itself, however, produces a contaminated waste water whose disposal constitutes a problem.

Between the initial activation (catalyst-treatment step) and the subsequent metal coating treatment it is necessary to provide a so-called acceleration treatment in a separate bath.

It has already been suggested to eliminate the acceleration treatment in copper-coating systems since the high alkalinity of a chemical plating copper bath solubilizes the tin protective coating without more. However, the elimination of the acceleration step renders the copper precipitation slow and creates problems with bubbling and poor adhesion in the event the metallized surface of the synthetic-resin body is to be galvanically plated subsequently.

Another disadvantage of this system (in which the acceleration step is eliminated) resides in that significant quantities of metallic palladium are carried into the copper bath so that the stability of this bath for chemical plating is reduced. Currentless copper plating has been found to be practical only in the printed-circuit arts while currentless metallization of other synthetic-resin surfaces for decorative effects have hitherto exclusively operated with chemical plating from nickel baths. Since the usual nickel chemical plating baths do not have either the acidity or the alkalinity which is necessary to remove the protective tin colloid, the acceleration step has been essential.

Thus for all practical purposes with conventional chemical plating nickel baths, the activation step (following the chemical roughening of the body surface) has been subdivided into two partial process steps, the first being the treatment with the catalyst in the colloid and the second being an acceleration step to enable chemical metal plating in a short period, preferably with a maximum of several minutes, i.e. a period preferably between 0.2 and 2 minutes, with uniform metal coating.

In the aforementioned German patent it has also been proposed to operate with alkali solutions in which the protective colloid is gelatin, albumen or tannic acid. In this system, of course, a subsequent acceleration treatment can be eliminated since these protective colloids are soluble in water. However, metallization of the synthetic-resin surface is not nearly as good with treatment from an alklali medium as treatment from acidic solutions which contain tin acid sols. Also with the alkali treatment, it is necessary to use long treatment times to obtain a uniform and effective coating.

In other conventional processes it is possible to eliminate the acceleration treatment and the disadvantages thereof, but these systems have other problems which also require two-stage treatments.

Thus it is known to chemically plate synthetic-resin with copper by chemically roughening the synthetic-resin surface in a chromic-sulfuric acid solution, sensitizing the surface in a tin (II)-chloride/hydrochloric acid solution activating the surface with ammoniacal silver nitrate, etc. Sensitization and activation are here the two process steps prior to chemical plating.

It is also known in a similar system to substitute a hydrochloric palladium solution or a palladium complex solution for the ammoniacal silver solution. In this sequence as well the sensitization step is reductive to the palladium compounds so that palladium nuclei coat the surface of the body and there serve to catalytically promote the deposition of copper or nickel for the copper or nickel chemical plating baths.

Other systems using the combination of sensitization and activation with tin chloride solutions or other reducing agents have also been proposed without eliminating the need for two-step treatment prior to chemical plating.

Thus all of the processes described above, to the extent they are practical, require a two-stage chemical treatment of the synthetic-resin surface between the chemical roughening step and the chemical plating from the metal bath.

OBJECT OF THE INVENTION

It is the principal object of the present invention to provide a process which obviates the aforedescribed disadvantages and allows activation without the acceleration step and, more particularly, provides a single stage activation which does not materially contaminate rinse water before the chemical plating or metallization stage.

DESCRIPTION OF THE INVENTION

The invention consists in a process for the chemical plating of synthetic-resin bodies with metals (currentless metallization) especially for synthetic-resin bodies such as ABS, in which the body is first chemically roughened and then treated with an aqueous activation bath of a metal salt of the platinum group of metals of gold capable of catalyzing the chemical plating of metal onto the body. The activation bath comprises a protective colloid and one or more carboxylic acids. Thereafter, and without intervening chemical steps or treatment, the body is introduced into a chemical plating bath containing the metal to be coated onto the body.

The invention resides in that the bath for the activation of the surface of the body uses gelatin and/or gum arabic as the protective colloid and a polybasic olefinic carboxylic acid as the carboxylic acid mentioned above, in that the synthetic-resin body is treated for at most several minutes (preferably 0.2 to 2 minutes) in the chemical plating bath (which may be of conventional composition), and in that there are no chemical treatment steps intervening between the activation treatment and the chemical plating step. In other words, the chemical plating step directly follows treatment of the surface of the synthetic-resin body with the activation bath.

According to a feature of the invention the activation bath can include, additionally, minor quantities of an inorganic acid capable of solubilizing the metal salt of the platinum group metal or gold, for example sulfuric acid or hydrochloric acid.

Still another feature of the invention provides that the activation bath can contain minor quantities of an inorganic acid to correct the value to between 1 and 3.

A surprising consequence of the use of an activation bath of the aforedescribed composition is that the acceleration treatment hereto is deemed necessary with acid baths is no longer required. It has heretofore not been recognized that with the use of water soluble gelatin or gum arabic and suitable reducing agents, metal colloids of the platinum group or gold, especially palladium colloids, can be formed in acid solution which have an excellent catalytic effect upon the chemically roughened synthetic-resin surface (analogous to that obtainable with a palladium chloride with tin acid protective colloids), without the requirement for an acceleration treatment or the like. Only a relatively slight acidity is required with the activation bath according to the invention and the latter is practically insensitive to the effect of atmospheric oxygen.

According to a particular feature of the invention the activation bath for carrying out the process of the present invention consists essentially of 0.1 to 20 g of gelatin, 1 to 50 g of tartaric acid, 1 to 5 g of sulfuric acid, 0.1 to 5 g of palladium sulfate, 1 to 20 g of maleic acid (cis-ethylenedicarboxylic acid) and sufficient water to bring the volume to 1 liter. The bath can also contain 0.1 to 20 g of gum arabic, 1 to 50 g of citric acid, 1 to 5 g hydrochloric acid, 0.1 to 5 g palladium chloride, 1 to 50 g (preferably 1 to 20 g) fumaric acid (trans-ethylenedicarboxylic acid) and sufficient water for a volume of 1 liter.

SPECIFIC EXAMPLES

Example I — Tested Activation Solutions

A.

0.1 g gelatin
5 g tartaric acid
4 g sulfuric acid
0.5 g palladium sulfate
5 g maleic acid
water to 1 liter

B.

5 g gelatin
10 g tartaric acid
2 g sulfuric acid
1 g palladium sulfate
10 g maleic acid
water to 1 liter

C.

15 g gelatin
25 g tartaric acid
5 g sulfuric acid
4 g palladium sulfate
15 g maleic acid
water to 1 liter

D.

20 g gelatin
50 g tartaric acid
5 g sulfuric acid
0.1 palladium sulfate
20 g maleic acid
water to 1 liter

E.

0.1 g gelatin
1 g tartaric acid
1 g sulfuric acid
5 g palladium sulfate
1 g maleic acid
water to 1 liter Note: It has been found to be unimportant whether or not another polybasic olefinic carboxylic acid, such as citric acid is substituted for the tartaric acid in each of the above-mentioned baths.

For the palladium sulfate in each of the examples acid-solubilized gold was also substituted with similar effects.

The resulting solution was successfully diluted with water in proportions of 1:1 to 1:10 with little adverse effect upon the activation characteristics.

Additional carboxylic acids or the identified inorganic acids could be used to maintain the pH between 1 and 3.

Fumaric acid could be used in place of the maleic acid although generally speaking was employed in smaller quantities because of its smaller solubility in water.

EXAMPLE II - TESTED ACTIVATION SOLUTIONS

A.

0.1 g gum arabic
1 g citric acid
1 g hydrochloric acid
0.1 g palladium chloride 1 g fumaric acid
water to 1 liter

B.

5 g gum arabic
10 g citric acid
2 g hydrochloric acid
1 g palladium chloride
5 g fumaric acid
water to 1 liter

C.

10 g gum arabic
20 g citric acid
3 g hydrochloric acid
3 g palladium chloride
15 g fumaric acid
water to 1 liter

D.

15 g gum arabic
40 g citric acid
4 g hydrochloric acid
4 g palladium chloride
15 g fumaric acid
water to 1 liter

E.

20 g gum arabic
50 g citric acid
5 g hydrochloric acid
5 g palladium chloride
20 g fumaric acid
water to 1 liter In each of the solutions of Examples I and II above, tests were carried out as follows:

An ABS extrusion (NOVODUR PM3c of BAYER) was treated first in an aqueous chromic sulfuric acid solution containing 300 g per liter of chrominum trioxide and 450 g per liter of constructed sulfuric acid at a temperature of 60° to 65° C for 10 to 20 minutes to chemically roughen the surface. The surface is detoxified in a sodium bisulfide solution and rinsed with water.

The synthetic-resin body was then treated with one of the solutions in Examples I and II for a period of 2 to 10 minutes at 20° to 50° C for activation, rinsed with water and thereafter nickel coated by chemical plating in an aqueous currentless nickel bath containing 20 g per liter of nickel sulfate, 40 g per liter of sodium hypophosphite and 40 g per liter of sodium citrate in water at a temperature of 50° to 60° C and a pH between 4 and 6. In each case, the plastic body was uniformly coated with nickel in a period of 0.2 to 2 minutes. A similar bath containing copper instead of nickel gave similar results, with copper being chemically deposited.

I claim:

1. In a process for the electroless metallization of a synthetic-resin body, especially a body composed of an ABS resin, whereby the surface of the body is treated with an activation bath containing a metal-deposition catalyzing metal salt of a platinum group metal or gold, a protective colloid and at least one carboxylic acid, and thereafter the activated surface is treated with a chemical metallizing bath, the improvement wherein:

said activation bath contains as the protective colloid, 0.1 to 20 g/liter of gelatin, gum arabic or mixtures thereof;

said activation bath contains, as said carboxylic acid, 1 to 100 g/liter of a polybasic olefinic carboxylic acid;

the pH of the activation bath is adjusted to a value of 1 to 3 with an inorganic acid; and the treatment with the chemical metallizing bath is effected without an acceleration treatment of the activated surface in a period up to two minutes.

2. The improvement defined in claim 1 wherein said inorganic acid is an acid capable of solubilizing said platinum group metal salt or gold.

3. The improvement defined in claim 2 wherein said acid is sulfuric acid or hydrochloric acid.

4. In a process for the currentless metallization of a synthetic-resin body, especially a body composed of an ABS resin, whereby the surface is treated with an activation bath containing a metal-precipitation-catalyzing metal salt of a platinum group metal or gold, a protective colloid and at least one carboxylic acid, and the activated surface is thereafter treated with a chemical plating bath to metallize the surface, the improvement wherein:

a. the protective colloid is selected from the group which consists of gelatin, gum arabic and mixtures thereof;

b. said carboxylic acid is a polybasic olefinic carboxylic acid;

c. the treatment with said chemical plating bath is carried out without acceleration treatment of the activated surface; and d. the treatment in said chemical plating bath is carried out for a period up to several minutes, said activation bath further including an inorganic acid selected from the group which consists of sulfuric acid and hydrochloric acid and capable of solubilizing said metal salt or gold, said process further comprising the step of adjusting the pH of said activation bath to a value between substantially 1 and 3, said activation bath consisting essentially of the listed ingredients in the proportions stated: 0.1 to 20 g of gelatin or gum arabic, 1 to 50 g of citric acid or tartaric acid, 1 to 5 g of sulfuric acid of hydrochloric acid, 0.1 to 5 g of palladium chloride or palladium sulfate, 1 to 20 g of maleic acid or 1 to 50 g of fumaric acid, and water to a volume of 1 liter.

5. The improvement defined in claim 4 wherein said activation bath has the following composition: 0.1 to 20 g of gelatin, 1 to 50 g of tartaric acid, 1 to 5 g sulfuric acid, 0.1 to 5 g palladium sulfate, 1 to 20 g maleic acid and water to a volume of 1 liter.

6. The improvement defined in claim 4 wherein said activation bath has the following composition: 0.1 to 20 g gum arabic, 1 to 50 g citric acid, 1 to 5 g hydrochloric acid, 0.1 to 5 g palladium chloride, 1 to 50 g fumaric acid and water to 1 liter.

7. An activation bath for activating the surface of a synthetic-resin body following the chemical roughening thereof and prior to the treatment of said surface with a chemical plating bath, comprising 0.1 to 20 g gelatin or gum arabic, 1 to 50 g tartaric acid or citric acid, 1 to 5 g sulfuric acid or hydrochloric acid, 0.1 to 5 g palladium sulfate, 1 to 20 g maleic acid or 1 to 50 g fumaric acid, and water to a volume of 1 liter.

8. The activation bath defined in claim 7 which consists essentially of: 0.1 to 20 g of gelatin, 1 to 50 g of tartaric acid, 1 to 5 g sulfuric acid, 0.1 to 5 g palladium sulfate, 1 to 20 g maleic acid, and water to a volume of 1 liter.

9. The activation bath defined in claim 7 which consists essentially of: 0.1 to 20 g gum arabic, 1 to 50 g citric acid, 1 to 5 g hydrochloric acid, 0.1 to 5 g palladium chloride, 1 to 50 g fumaric acid, and water to 1 liter.

* * * * *